US008869523B2

(12) United States Patent
Chadwick et al.

(10) Patent No.: US 8,869,523 B2
(45) Date of Patent: Oct. 28, 2014

(54) CONTROL SYSTEM HAVING VARIABLE-SPEED ENGINE-DRIVE FAN

(75) Inventors: Michael J. Chadwick, Cary, NC (US); Jared P. Johnson, Fuquay Varina, NC (US); Gregory G. Hermann, Apex, NC (US); Thomas G. Pusch, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 853 days.

(21) Appl. No.: 13/086,966

(22) Filed: Apr. 14, 2011

(65) Prior Publication Data

US 2012/0260867 A1 Oct. 18, 2012

(51) Int. Cl.
*F01P 7/04* (2006.01)

(52) U.S. Cl.
CPC ..... *F01P 7/044* (2013.01)
USPC ..... 60/490

(58) Field of Classification Search
USPC ..... 60/490, 912; 123/41.11, 41.12
See application file for complete search history.

(56) References Cited

U.S. PATENT DOCUMENTS

| | | | | |
|---|---|---|---|---|
| 3,359,831 | A | 12/1967 | Scheiter | |
| 3,659,419 | A * | 5/1972 | Ikeda | 60/456 |
| 3,888,372 | A | 6/1975 | Gorby et al. | |
| 4,186,693 | A | 2/1980 | Thien et al. | |
| 4,223,646 | A | 9/1980 | Kinder | |
| 4,325,330 | A * | 4/1982 | Kugler et al. | 123/41.12 |
| 4,441,462 | A | 4/1984 | Budinski | |
| 4,692,053 | A * | 9/1987 | Sampedro | 123/41.49 |
| 4,879,867 | A | 11/1989 | Wenzel | |
| 5,209,189 | A | 5/1993 | Weitzenbuerger et al. | |
| 5,690,391 | A | 11/1997 | Kingsley et al. | |
| 5,747,883 | A | 5/1998 | Hammer et al. | |
| 6,050,228 | A | 4/2000 | Garnett et al. | |
| 6,349,882 | B1 | 2/2002 | Kita et al. | |
| 7,028,646 | B1 | 4/2006 | Wagner | |
| 7,245,033 | B2 | 7/2007 | Wurtele | |
| 7,397,354 | B1 | 7/2008 | Easton | |
| 8,015,953 | B2 * | 9/2011 | Stramecki | 123/41.12 |
| 8,015,954 | B2 * | 9/2011 | Kardos | 123/41.12 |
| 2004/0011306 | A1 * | 1/2004 | Liederman et al. | 123/41.12 |
| 2006/0096554 | A1 * | 5/2006 | Shiozaki | 123/41.12 |
| 2008/0141976 | A1 * | 6/2008 | Akagi et al. | 123/350 |
| 2008/0164989 | A1 | 7/2008 | Easton | |

FOREIGN PATENT DOCUMENTS

| | | |
|---|---|---|
| JP | 10068142 | 3/1998 |
| KR | 1020050094344 | 9/2005 |

* cited by examiner

*Primary Examiner* — Thomas E Lazo
(74) *Attorney, Agent, or Firm* — Finnegan, Henderson, Farabow, Garrett & Dunner LLP

(57) ABSTRACT

A control system for use with a machine having an engine is disclosed. The control system may have a cooling circuit, a heat exchanger associated with the cooling circuit, and a sensor configured to generate a signal indicative of a temperature of the cooling circuit. The cooling system may also have a fan mechanically driven by the engine to direct air through the cooling circuit, and a controller in communication with the sensor and the engine. The controller may be configured to adjust a speed of the engine based on the signal.

18 Claims, 2 Drawing Sheets

CONTROL SYSTEM HAVING VARIABLE-SPEED ENGINE-DRIVE FAN

TECHNICAL FIELD

The present disclosure is directed to a control system and, more particularly, to a control system having a variable-speed engine-driven fan.

BACKGROUND

Most engines combust a mixture of air and fuel to generate a mechanical, hydraulic, or electrical power output. In order to improve combustion of the air/fuel mixture and protect components of the engine from damaging extremes, temperatures of the engine and air drawn into the engine for combustion should be tightly controlled. For this reason, combustion engines are generally fluidly connected to several different liquid-to-air and/or air-to air heat exchangers to cool both liquids and gases circulated throughout the engine. An engine-driven fan is disposed either in front of the exchanger to blow air across the exchanger and the associated engine, or between the exchanger and engine to suck air past the engine and blow air past the exchanger. The airflow from the fan may function to remove heat from the heat exchanger and the engine.

Although this cooling arrangement may improve combustion in extreme conditions and thereby help to reduce a likelihood of engine damage caused by high temperatures, it may suffer from inefficiencies. In particular, when a fan is mechanically coupled to an engine, the speed of the fan is dependent on engine speed, which is generally the result of a desired machine travel speed and/or an actual loading condition. Accordingly, conventional fans are only able to rotate at a speed that is some fixed ratio of a travel or load-governed engine speed. In some situations, this speed may be sufficient to provide a desired amount of cooling. In other situations, however, this fixed ratio may result in too little or too much cooling, which may cause reduced engine efficiencies.

One way to improve cooling-related engine efficiencies is described in U.S. Pat. No. 5,747,883 (the '883 patent) issued to Hammer et al. on May 5, 1998. The '883 patent discloses an engine-driven fan that circulates air through a powertrain compartment and radiator. Specifically, the '883 patent describes an engine that is drivingly connected with an output shaft on which is disposed a bevel gear. The bevel gear is connected to a variable drive mechanism, such as pairs of slipping clutches, belt drives, or a hydrostatic transmission. The bevel gear is also connected through a pair of spur gears to a modulating shaft having a hub with a plurality of integral fan blades. The modulating shaft and integral fan blades are driven by the engine via the bevel and spur gears, with a speed of the shaft and blades being varied relative to engine speed by the variable drive mechanism.

Although perhaps an improvement over fixed ratio fan systems, the cooling system of the '883 patent may still be less than optimal. In particular, the added components of the variable drive mechanism that are required to provide for decoupling of engine speed and fan speed may be complex, reduce reliability, and increase system costs.

The control system of the present disclosure solves one or more of the problems set forth above and/or other problems in the art.

SUMMARY

One aspect of the present disclosure is directed to a control system for use with a machine having an engine. The control system may include a cooling circuit, a heat exchanger associated with the cooling circuit, and a sensor configured to generate a signal indicative of a temperature of the cooling circuit. The cooling system may also include a fan mechanically driven by the engine to direct air through the cooling circuit, and a controller in communication with the sensor and the engine. The controller may be configured to adjust a speed of the engine based on the signal.

A second aspect of the present disclosure is directed to another control system for use with a transmission driven by an engine to rotate a traction device. This control system may include a sensor configured to generate a signal indicative of a desired change in engine speed, and a controller in communication with the sensor and the engine. The controller may be configured to determine, before implementation of the desired change in engine speed, an adjustment to the transmission based on the desired change in engine speed that maintains a substantially constant travel speed. The controller may also be configured to implement the adjustment at about the same time as the desired change in engine speed.

A third aspect is directed to a method of cooling a machine system. The method may include generating a signal indicative of a temperature of the machine system, determining a desired cooling fan speed change based on the signal, and determining an engine speed change required to produce the desired cooling fan speed change. The method may also include determining, prior to implementation of the engine speed change, a transmission adjustment required to maintain a substantially constant travel speed during implementation of the engine speed change, and implementing the transmission adjustment at about the same time as the engine speed change.

DETAILED DESCRIPTION

Figure 1:
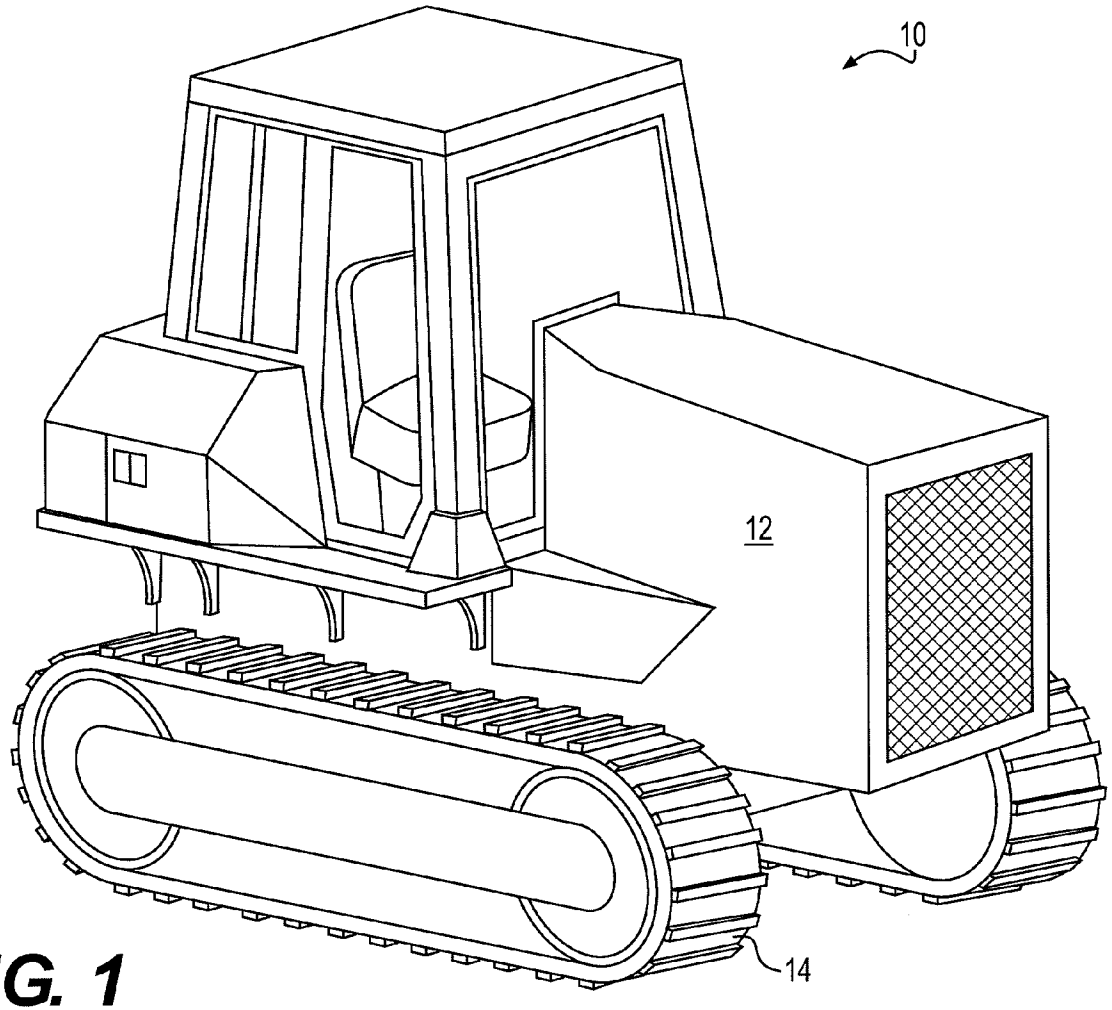
FIG. 1 is a pictorial illustration of an exemplary disclosed machine.

FIG. 1 illustrates an exemplary machine 10. Machine 10 may be a mobile machine that performs some type of operation associated with an industry such as mining, construction, farming, transportation, or any other industry known in the art. For example, machine 10 may be an earth moving machine such as a track-type tractor, a skid-steer loader, a wheel loader, or an off-highway haul truck. Machine 10 may alternatively embody an on-highway truck, a passenger vehicle, or any other suitable operation-performing machine.

Machine 10 may include a power source 12, a traction device 14, and a transmission 16 (shown only in FIG. 2) configured to transmit a power output from power source 12 to traction device 14 in response to an input received from an operator of machine 10. It should be noted that, although only one transmission 16 and one traction device 14 are illustrated in FIG. 2, machine 10 may typically include two transmissions 16 and two traction devices 14 arranged into two substantially identical drive trains that can be powered by power source 12 and independently controlled by the operator of machine 10.

Power source 12 may be configured to produce a power output and may include an internal combustion engine. For example, power source 12 may include a diesel engine, a gasoline engine, a gaseous fuel-powered engine, or any other type of engine apparent to one skilled in the art. It is contemplated that power source 12 may alternatively embody a non-combustion source of power such as a fuel cell, a battery, or an electric motor, if desired. Power source 12 may produce a rotational mechanical output received by transmission 16.

Traction device 14 may embody a track located on a side of machine 10. When two drive trains are included within machine 10, the two associated traction devices 14 may be located on opposing sides of machine 10 and simultaneously controlled to propel machine 10 or independently controlled to steer machine 10. Alternatively, traction device 14 may embody a wheel, a belt, or any other driven traction device. Traction device 14 may be driven by transmission 16 to rotate in accordance with an output rotation of power source 12.

Figure 2:
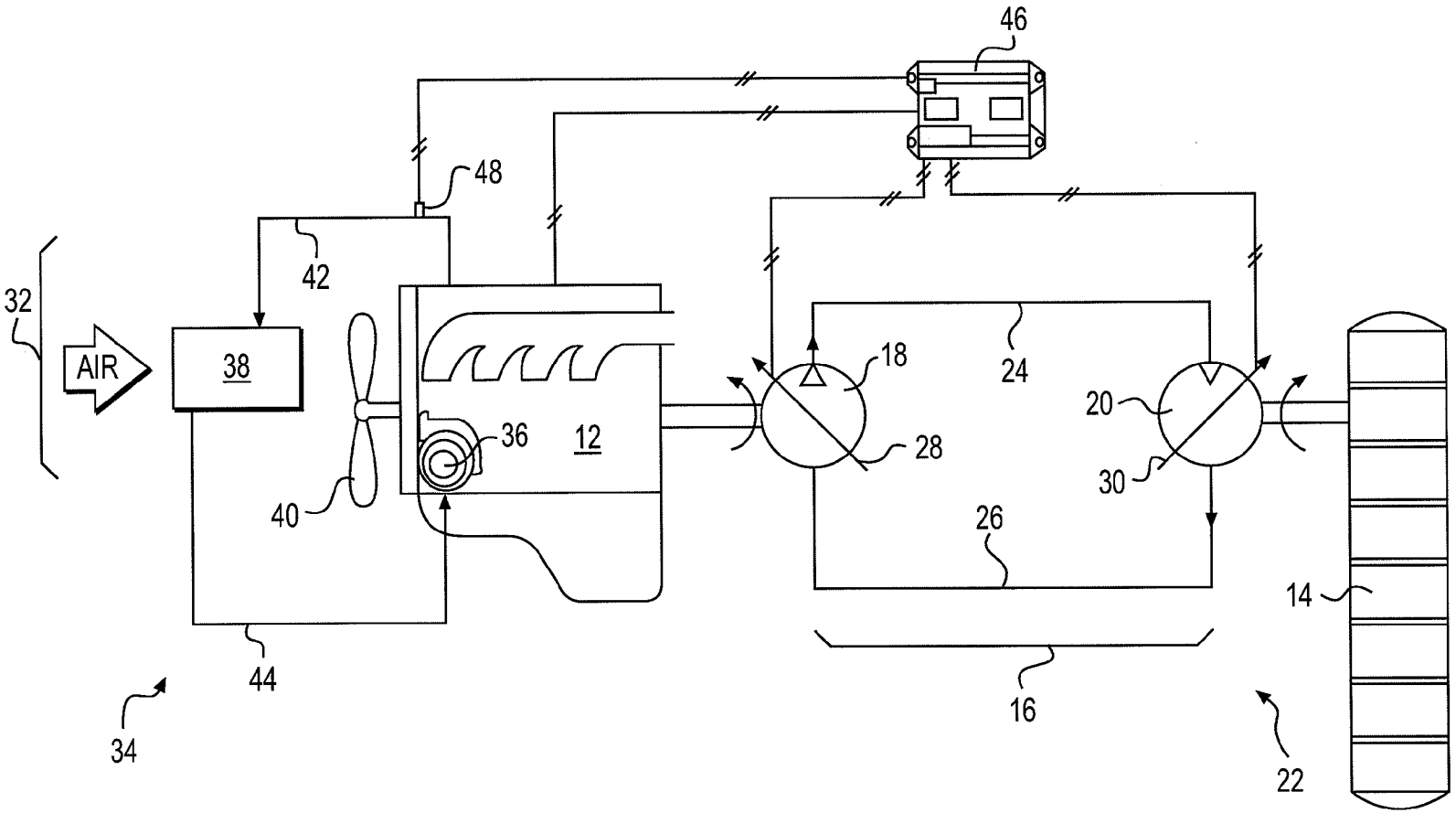
FIG. 2 is diagrammatic illustration of an exemplary disclosed control system that may be used with the machine of FIG. 1.

As shown in FIG. 2, transmission 16 may be a continuously variable transmission having a pump 18 and a motor 20 coupled in a closed-loop hydraulic circuit 22 (i.e., transmission 16 may be a hystat transmission). Pump 18 may be mechanically driven by power source 12 to pressurize fluid, while motor 20 may be driven by the pressurized fluid to mechanically rotate traction device 14 at a reduced ratio corresponding to the displacement position of pump 18 and/or motor 20. A first passage 24 may direct pressurized fluid discharged from pump 18 to motor 20, while a second passage 26 may return used fluid from motor 20 to pump 18. It is contemplated that, in some situations, the functions of first and second passages 24, 26 may be reversed to thereby reverse the travel direction of traction device 14, if desired.

Pump 18 may be a swashplate-type pump and include multiple piston bores (not shown), and pistons (not shown) disposed within the bores against a tiltable swashplate 28. The pistons may reciprocate within the bores to produce a pumping action as swashplate 28 rotates relative to the pistons (swashplate 28 may rotate while the pistons and associated bores remain stationary, or the pistons and bores may collectively rotate while swashplate 28 remains stationary). Swashplate 28 may be selectively tilted relative to a longitudinal axis of the pistons to vary a displacement of the pistons within their respective bores and a corresponding output of pump 18. Although shown in FIG. 1 as producing only a unidirectional flow of pressurized fluid, it is contemplated that pump 18 may be an over-center type pump or be rotatable in two directions, if desired.

When swashplate 28 rotates relative to the pistons, the angled driving surface of swashplate 28 may drive each piston through a reciprocating motion within each bore. When the piston is retracting from the bore, fluid may be allowed to enter the bore. When the piston is moving into the associated bore under the force of the driving surface, the piston may force the fluid from the bore toward motor 20 via passage 24. The angular setting of swashplate 28 relative to the pistons may be carried out by any actuator known in the art, for example, by a servo motor.

Motor 20 may be a fixed or variable displacement type motor fluidly coupled to pump 18. Motor 20 may convert the pressurized fluid from pump 18 into the rotational output of traction device 14. As a variable displacement motor, motor 20 may include multiple piston bores (not shown), and pistons (not shown) disposed within the bores against a fixed or rotatable swashplate 30. Pressurized fluid may be allowed to enter the bores to force the pistons to move toward the swashplate 30. As the pistons press against swashplate 30, swashplate 30 may be urged to rotate relative to the pistons (swashplate 30 may rotate while the pistons remain stationary, or the pistons may rotate while swashplate 30 remains stationary), thereby converting the fluid energy into a rotational output. The angle of swashplate 30 may determine an effective displacement of the pistons relative to the bores of motor 20 and a corresponding torque and/or speed of traction device 14. As swashplate 30 continues to rotate relative to the pistons, the fluid may be discharged from each bore to return to pump 18 by way of passage 26. The angular setting of swashplate 30 relative to the pistons may be carried out by any actuator known in the art, for example, by a servo motor.

The displacement of pump 18, together with the displacement of motor 20, may affect a ratio of the speed and/or torque transferred from power source 12 to traction device 14 by transmission 16 (i.e., the displacement of pump 18 and motor 20 may together affect an actual gear ratio of transmission 16). For the purposes of this disclosure, the actual gear ratio of transmission 16 may be considered the ratio of the input speed and/or torque of transmission 16 (i.e., the output speed and/or torque of power source 12) relative to an output speed and/or torque of transmission 16 (i.e., the rotational speed and/or torque of traction device 14). Thus, for a given mechanical input from power source 12 and for a fixed displacement of motor 20, a larger displacement of pump 18 may result in a higher speed and a lower torque rotation of traction device 14. Similarly, for the same input from power source 12 and for a fixed displacement of pump 18, a larger displacement of motor 20 may result in a lower speed and a higher torque rotation of traction device 14. By varying the displacements of both pump 18 and motor 20 simultaneously, a greater range of speed and torque may be provided to traction device 14 with finer control. The actual gear ratio of transmission 16 may be determined as a function of the input and output speeds and/or torques of transmission 16, which may be measured or estimated values. However, it is contemplated that the actual gear ratio of transmission 16 may alternatively be determined as a function of the displacement settings of pump 18 and motor 20, if desired.

As also shown in FIG. 2, machine 10 may include a cooling system 32 having multiple components that cooperate to control temperatures of power source 12. Specifically cooling system 32 may include, among other things, a cooling circuit 34, a pump 36, a heat exchanger 38, and a fan 40. Coolant such as water, glycol, a water/glycol mixture, a blended air mixture, or another heat transferring medium may be circulated by pump 36 through cooling circuit 34 to absorb heat from power source 12. After exiting power source 12, the coolant may be directed through a passage 42 to heat exchanger 38 to transfer the absorbed heat to a flow of air generated by fan 40, and then be drawn through a passage 44 back to pump 36.

Pump 36 may be engine-driven to generate the flow of coolant described above. In one example, pump 36 may include an impeller (not shown) disposed within a volute housing having an inlet connected to passage 44 and an outlet connected to internal passages of power source 12. As the coolant enters the volute housing, blades of the impeller may be rotated by operation of power source 12 to push against the coolant, thereby pressurizing the coolant. An input torque imparted by power source 12 to pump 36 may be related to a pressure of the coolant, while a speed imparted to pump 36 may be related to a flow rate of the coolant. It is contemplated that pump 36 may alternatively embody a gear or piston type pump, if desired, and may have a variable or fixed displacement.

Heat exchanger 38 may embody the main radiator (i.e., the high temperature radiator) of power source 12 and be situated to dissipate heat from the coolant after it passes through and absorbs heat from power source 12. As the main radiator of power source 12, heat exchanger 38 may be an liquid-to-air type of exchanger. That is, the flow of air generated by fan 40 may be directed through channels of heat exchanger 38 such that heat from the coolant in adjacent channels is transferred to the air. In this manner, the coolant passing through power source 12 may be cooled to below a predetermined operating temperature associated with a speed and flow rate of fan 40. It is contemplated that an additional heat exchanger (not shown), for example an air-to-air heat exchanger, may be included within machine 10 to provide for cooling of combustion air, if desired.

Fan 40 may be disposed proximate to heat exchanger 38 and mechanically driven by power source 12 to produce a flow of air across heat exchanger 38 and/or power source 12 for heat transfer therewith. Fan 40 may be directly connected to power source 12, for example by way of a fixed mechanical connection with an output shaft of power source 12. Alternatively, fan 40 may be indirectly mechanically connected to power source 12 and driven by way of a belt-and-pulley system, by way of a gear reduction system, or in another appropriate manner. In either the direct or indirect connection configurations, fan 40 may rotate in a fixed-ratio relationship relative to a speed of power source 12. That is, the ratio of power source output speed to fan speed may remain fixed, regardless of the type of connection between fan 40 and power source 12.

In most situations, a speed of power source 12 may be controlled based on, among other things, an operator-desired machine travel speed, a loading condition of machine 10, and/or a mode of operation. For example, if an operator desires a higher travel speed within a particular transmission gear ratio and/or during operation under a given load, power source output speed may be increased to accommodate the operator's desire. In another example, a change in load caused by varying conditions of a machine work tool (not shown) and/or changing worksite terrain may call for an increase or decrease in power source speed. Different modes of operation, for example an economy mode, a travel mode, a working mode, etc., may also call for changes in power source speed. In all of these conditions, the change in power source speed may generally be accommodated by adjusting fueling of power source 12 (for a substantially constant load). That is, to increase a speed of power source 12 under a given loading condition, fueling of power source 12 should be increased. Similarly, to decrease a speed of power source 12 under a given loading condition, fueling of power source 12 should be decreased. Accordingly, during operation of machine 10, any number of different signals may be generated calling for changes in fueling in order to vary a speed of power source 12.

Cooling system 32 may also request changes in fueling to bring about changes in the speed of power source 12 and, subsequently, the speed and flow rate of fan 40. That is, because fan 40 may be connected to rotate in a fixed relationship relative to an output speed of power source 12, a change in power source speed may result in a corresponding change in fan speed and flow rate. Cooling system 32 may include a controller 46 to regulate power source speed changes related to cooling system requirements.

Controller 46 may embody a single microprocessor or multiple microprocessors that include a means for receiving input from a temperature sensor 48 associated with cooling system 32 and for providing output to control the speed of power source 12. Numerous commercially available microprocessors may be configured to perform the functions of controller 46. It should be appreciated that controller 46 may readily embody a general machine microprocessor capable of controlling numerous machine functions. Various other circuits may be associated with controller 46, such as power supply circuitry, signal conditioning circuitry, data acquisition circuitry, signal output circuitry, signal amplification circuitry, and other types of circuitry known in the art.

Temperature sensor 48 may be associated with any one or both of passages 42, 44, with heat exchanger 38, and/or with power source 12 to sense a temperature of fluid therein. Temperature sensor 48 may generate a signal indicative of the measured value, and direct the signal to controller 46 for further processing.

Controller 46 may be in communication with sensor 48 and with power source 12 to affect control of machine 10 in response to the signal from temperature sensor 48 (i.e., controller 46, together with sensor 48 and cooling system 32, may form a control system of machine 10). Controller 46 may be configured to adjust the speed of power source 12 when an actual temperature of cooling system 32 deviates from a desired temperature by at least a threshold amount. The threshold amount may be fixed during manufacture of machine 10 and/or adjustable by an operator thereof. When the signal indicates an actual cooling system temperature greater or less than the desired temperature by the threshold amount, controller 46 may be configured to adjust fueling of power source 12 and thereby change the speed and flow rate of fan 40 to reduce a difference between the actual and desired temperatures. For example, when the signal indicates a cooling system temperature significantly higher than a desired temperature, controller 46 may be configured to adjust fueling of power source 12 and thereby increase the speed and flow rate of fan 40 to decrease the temperature of cooling system 32.

Controller 46 may include one or more maps stored within an internal memory thereof, which controller 46 may reference during open-loop fueling control of power source 12. Each of these maps may include a collection of data in the form of tables, graphs, and/or equations. For example, a first map may relate the actual cooling system temperature (as measured by sensor 48) to a desired change in power source speed, while a second map may relate the desired change in power source speed to a required change in power source fueling. Alternatively, the actual cooling system temperature may be directly related to the required change in power source fueling, if desired. Controller 46 may reference these maps to determine the change in fueling required to sufficiently stabilize or maintain the temperatures of cooling system 32, and implement the fueling change based on the signal from sensor 48. It is contemplated that, instead of or in addition to open-loop control of fueling, controller 46 may be configured to implement closed-loop control during which fueling of power source 12 may be incrementally adjusted based on feedback from sensor 48 until a desired cooling system temperature is achieved.

In some situations, multiple competing demands for changes in power source speed may be simultaneously generated by different sources and received by controller 46. For example, an operator may generate a first signal indicative of a first desired increase in travel speed that requires a corresponding increase in power source speed. At this same time, sensor 48 may generate a second signal indicative of a second desired increase in power source speed different from the first desired increase in power source speed. In these situations, controller 46 may be configured to arbitrate the different speed change demands and implement a single fueling adjustment of power source 12. Specifically, controller 46, upon receiving the first and second signals, may compare the signals and determine which of the signals is associated with a greater change in power source speed. Controller 46 may then adjust fueling of power source 12 based on the greater change.

Transmission 16, because of its connection to power source 12, may be affected by changes in power source speed. That is, if unaccounted for, an increase or decrease in power source speed, may result in a corresponding increase or decrease in travel speed. Unexpected changes in travel speed may be undesired by the operator. Accordingly, controller 46 may be configured to adjust operation of transmission 16 to account for the change in power source speed.

Controller 46 may adjust operation of transmission 16 to account for the change in power source speed by changing a gear ratio of transmission 16. For example, a power source speed increase that would normally result in a travel speed increase may be accommodated by reducing the gear ratio of transmission 16. Similarly, a power source speed reduction that would normally result in a travel speed decrease may be accommodated by increasing the gear ratio of transmission 16. As described above, the gear ratio of transmission 16 may be adjusted by changing a displacement of pump 18 and/or motor 20. Specifically, to increase the gear ratio of transmission 16, the displacement of pump 18 may be increased, the displacement of motor 20 may be decreased, or both the pump displacement increase and the motor displacement decrease may be implemented substantially simultaneously. Similarly, to decrease the gear ratio of transmission 16, the displacement of pump 18 may be decreased, the displacement of motor 20 may be increased, or both the pump displacement decrease and the motor displacement increase may be implemented substantially simultaneously.

In the disclosed embodiment, the change in power source speed may be anticipated and the transmission adjustment implemented such that a travel speed deviation is reduced, if not completely eliminated. That is, after determining which signal request for a change in power source speed shall be implemented, controller 46 may then determine a corresponding change in the gear ratio of transmission 16 that should maintain a substantially constant travel speed (i.e., a travel speed having a deviation less than a desired amount). Controller 46 may then implement the power source speed change and transmission adjustment at the appropriate timings such that the travel speed of machine 10 remains substantially unaffected by the change in power source speed. In one embodiment, controller 46 may implement the power source speed change and transmission adjustment substantially simultaneously.

INDUSTRIAL APPLICABILITY

The control system of the present disclosure may be applicable to any machine where cooling system efficiency, complexity, reliability, and cost are important. The disclosed control system may improve cooling system efficiency by providing for variable fan speed control based on temperature. The disclosed control system may require few additional or dedicated components to provide for the variable fan speed control, and the disclosed fan may be mechanically connected directly to power source 12. The limited number of components and simple mechanical connections may improve reliability and reduce system cost.

It will be apparent to those skilled in the art that various modifications and variations can be made to the control system of the present disclosure without departing from the scope of the disclosure. Other embodiments will be apparent to those skilled in the art from consideration of the specification and practice of the control system disclosed herein. For example, although machine 10 is described as including a hystat type of transmission, it is contemplated that the disclosed control system may also be applicable to other types of transmissions, if desired. It is intended that the specification and examples be considered as exemplary only, with a true scope of the disclosure being indicated by the following claims and their equivalents.

What is claimed is:

1. A control system for a machine having an engine, comprising:

a cooling circuit;

a heat exchanger associated with the cooling circuit;

a sensor configured to generate a signal indicative of a temperature of the cooling circuit;

a fan mechanically driven by the engine to direct air through the heat exchanger; and a controller in communication with the sensor and the engine, the controller configured to adjust a speed of the engine based on the signal by adjusting fueling of the engine by an amount related to a desired seed of the fan.

2. The control system of claim 1, wherein the fan rotates at a fixed ratio relative to the speed of the engine.

3. The control system of claim 1, wherein:

the machine includes a transmission driven by the engine to rotate a traction device; and the controller is further configured to adjust the transmission to account for a change in travel speed caused by an adjustment in fueling of the engine implemented based on the signal.

4. The control system of claim 3, wherein:

the transmission is a hystat transmission; and the controller is configured to adjust the transmission by adjusting a displacement of at least one of a pump and a motor of the transmission.

5. The control system of claim 3, wherein the controller is configured to:

determine an adjustment to the transmission required to account for the change in travel speed prior to implementing the adjustment in fueling; and implement the adjustment to the transmission while adjusting fueling based on the signal to maintain a substantially constant travel speed during fuel adjusting.

6. The control system of claim 5, wherein:

the signal is a first signal;

the controller is configured to determine a first desired engine speed based on the first signal;

the controller is further configured to receive a second signal not associated with the sensor that is indicative of a second desired change in engine speed; and the controller is configured to adjust the engine speed and determine the adjustment to the transmission based on a greater one of the first and second desired changes in engine speed.

7. A control system for a machine having a transmission driven by an engine to rotate a traction device, the control system comprising:

a sensor configured to generate a signal indicative of a desired change in engine speed; and a controller in communication with the sensor and the engine, the controller being configured to:

determine, before implementation of the desired change in engine speed, an adjustment to the transmission based on the desired change in engine speed that maintains a substantially constant travel speed; and implement the adjustment at about the same time as the desired change in engine speed.

8. The control system of claim 7, wherein the sensor is a temperature sensor.

9. The control system of claim 8, wherein the desired change in engine speed is associated with a speed change of a cooling fan that is mechanically driven by the engine.

10. The control system of claim 7, wherein the controller is configured to adjust the speed of the engine by adjusting fueling of the engine.

11. The control system of claim 7, wherein the controller is configured to adjust the transmission by adjusting a gear ratio of the transmission.

12. The control system of claim 11, wherein:

the transmission is a hystat transmission; and the controller is configured to adjust the gear ratio by adjusting a displacement of at east one of a pump and a motor of the transmission.

13. The control system of claim 7, wherein:

the signal is a first signal;

the desired change in engine speed is a first desired change in engine speed;

the controller is further configured to receive a second signal not associated with the sensor that is indicative of a second desired change in engine speed; and the controller is configured to determine the transmission adjustment based on the one of the first and second signals that is indicative of a greater desired change in engine speed.

14. A method of cooling a machine system, comprising:

generating a signal indicative of a temperature of the machine system;

determining a desired cooling fan speed change based on the signal;

determining an engine speed change required to produce the desired cooling fan speed change;

determining, prior to implementation of the engine speed change, a transmission adjustment required to maintain a substantially constant travel speed during implementation of the engine speed change; and implementing the transmission adjustment at about the same time as the engine speed change.

15. The method of claim 14, wherein determining an engine speed change includes determining a change in engine fueling.

16. The method of claim 14, wherein determining a transmission adjustment includes determining a displacement adjustment of at least one of a transmission pump or motor.

17. The method of claim 14, wherein:

determining the engine speed change required to produce the desired cooling fan speed change includes determining a first engine speed change;

the method further includes determining a second engine speed change not associated with the desired cooling fan speed change;

determining the transmission adjustment includes determining the transmission adjustment required to maintain a substantially constant travel speed during implementation of a greater one of the first and second engine speed changes; and the method further includes implementing the transmission adjustment at about the same time as the greater one of the first and second engine speed changes.

18. A machine, comprising:

an engine configured to produce a mechanical output;

a cooling circuit configured to circulate fluid through the engine;

a heat exchanger associated with the cooling circuit;

a fan mechanically driven by the engine to direct air through the heat exchanger;

a sensor configured to generate a signal associated with a temperature of the engine;

a traction device configured to receive a mechanical input and propel the machine;

a transmission fluidly connecting the mechanical output to the mechanical input, the transmission including:

a pump connected to the mechanical output of the engine; and a motor configured to receive pressurized fluid from the pump and being connected to the mechanical input of the traction device; and a controller in communication with the engine, the transmission, and the sensor, the controller being configured to:

determine a first desired speed change of the engine based on the signal;

determine a second desired speed change of the engine not associated with the signal;

determine, prior to implementation of the first or second desired speed changes, a transmission adjustment required to maintain a substantially constant travel speed during implementation of a greater one of the first and second desired speed changes; and implement the transmission adjustment at about the same time as the greater one of the first and second desired speed changes.

* * * * *

UNITED STATES PATENT AND TRADEMARK OFFICE

CERTIFICATE OF CORRECTION

PATENT NO. : 8,869,523 B2
APPLICATION NO. : 13/086966
DATED : October 28, 2014
INVENTOR(S) : Chadwick et al.

It is certified that error appears in the above-identified patent and that said Letters Patent is hereby corrected as shown below:

Title Page, Item 54 and in the Specification, Column 1, line 2, (Title), delete "ENGINE-DRIVE" and insert -- ENGINE-DRIVEN --.

In the claims

Column 9, line 13, in Claim 12, delete "east" and insert -- least --.

Signed and Sealed this
Seventeenth Day of November, 2015

Michelle K. Lee

Michelle K. Lee
*Director of the United States Patent and Trademark Office*